US006411096B1

(12) United States Patent
Anthoni et al.

(10) Patent No.: US 6,411,096 B1
(45) **Date of Patent: *Jun. 25, 2002**

(54) SCOPE ANALYZER FOR DIRECT IGNITION ENGINES

(75) Inventors: Carel C. Anthoni, Nieuwkoop (NL); Tyrone J. Moritz, Morton Grove, IL (US); Yosuf M. Taraki, Evanston, IL (US); Dale A. Trsar, Mount Prospect, IL (US); Richard H. Sheperd, McHenry, IL (US)

(73) Assignee: Snap-on Tools Company, Kenosha, WI (US)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/036,192

(22) Filed: Mar. 6, 1998

(51) Int. Cl.[7] ..... G06G 7/70
(52) U.S. Cl. ..... 324/379; 701/102
(58) Field of Search ..... 364/551, 431.03; 345/140; 701/102, 29; 324/158.1, 379

(56) References Cited

U.S. PATENT DOCUMENTS 4,375,672 A * 3/1983 Kato et al. ..... 364/551
5,132,626 A 7/1992 Shaland
5,175,501 A 12/1992 Loewe et al.
5,218,302 A 6/1993 Loewe et al.
5,258,753 A * 11/1993 Jonker et al. ..... 345/140
5,307,017 A 4/1994 Maruyama et al.
5,387,870 A 2/1995 Knapp et al.
5,444,376 A 8/1995 Dittmann et al.
5,453,694 A 9/1995 Miyata et al.
5,493,496 A 2/1996 James et al.
5,534,781 A 7/1996 Lee et al.
5,614,828 A 3/1997 Sims
5,680,311 A * 10/1997 Trsar et al. ..... 364/431.03
5,778,328 A * 7/1998 Trsar et al. ..... 701/29
5,852,789 A * 12/1998 Trsar et al. ..... 701/102
5,935,187 A * 8/1999 Trsar et al. ..... 701/102
5,941,926 A * 8/1999 Taraki et al. ..... 701/102

* cited by examiner

*Primary Examiner*—Michael J. Sherry
*Assistant Examiner*—Jimmy Nguyen
(74) *Attorney, Agent, or Firm*—Seyfarth Shaw

(57) ABSTRACT

An engine analyzer stores acquired cylinder waveform data in circular buffers respectively associated with the cylinders in accordance with cylinder selection by the user, with each buffer including a plurality of storage cells respectively storing data for individual firing cycles of the associated cylinder, and simultaneously displays the waveform for a, single selected cylinder on one trace of a display screen and waveforms for all cylinders for which data is stored on a second trace, so that data can be acquired and displayed from direct ignition engines with the use of a single pickup lead connected to selected cylinders one cylinder at a time. Various display modes are possible, including a frozen mode in which all stored waveform data may be reviewed and displayed.

18 Claims, 9 Drawing Sheets

SCOPE ANALYZER FOR DIRECT IGNITION ENGINES

BACKGROUND OF THE INVENTION

The present invention relates to digital engine analyzers incorporating display devices. The invention has particular application to the use of such analyzers for analysis of particular types of engines.

It is known to provide engine analyzers with display screens which may constitute digital oscilloscopes. It is also known to provide such display screens with multiple display traces (e.g., two), so that a number of waveforms can be simultaneously displayed. Such analyzers acquire analog waveforms from an associated engine by means of pickup leads and then digitize the waveforms for storage in memory and display on the screen.

Such analyzers typically have a plurality of signal pickup leads adapted to be connected to selected points on a multi-cylinder internal combustion engine for,acquiring input analog waveform signals therefrom. These leads commonly include primary and secondary pickup leads for, respectively, acquiring signals from the primary and secondary windings of an ignition coil. Conventional ignition systems have a single ignition coil and a distributor for routing the secondary voltage to multiple spark plugs. With a conventional ignition system two probes are commonly used to obtain and identify the signals for all cylinders: one probe to obtain a common primary or secondary signal and a second probe to obtain a reference signal from one of the spark plug wires. This reference or sync signal is typically acquired from the spark plug wire for the no. 1 cylinder in the firing order. Thus, this lead permits the analyzer to keep track of which cylinder is firing, once the firing order of the engine is known.

In direct ignition engines each cylinder is provided with its own ignition coil having primary and secondary windings. Thus, existing engine analyzers have not been usable with direct ignition engines, since they are provided with only one primary and one secondary pickup lead. In order to view simultaneously ignition signals for multiple cylinders of a direct ignition engine, a separate set of probes for each cylinder would be required and no such arrangement is available in current analyzers.

Copending U.S. application Ser. No. 08/630,382, filed Apr. 10, 1996 and entitled "Engine Analyzer with Single-Lead Ignition Scope", now U.S. pat. No. 5,778,328, discloses a digital engine analyzer which permits an operator to view the secondary signal for a specific cylinder by the use of only a single secondary pickup lead. However, that system, which is provided in order to enable an operator to make a quick check of an engine ignition system, permits the user to view only waveforms from the single cylinder to which the pickup lead is currently connected.

SUMMARY OF THE INVENTION

It is a general object of the invention to provide an improved engine analyzer apparatus which avoids the disadvantages of prior such apparatuses while affording additional structural and operating advantages.

An important feature of the invention is the provision of an engine analyzer with a display screen which can acquire and simultaneously display ignition signals from all cylinders of an engine with a direct, coil-per-cylinder ignition system.

In connection with the foregoing feature, another feature of the invention is the provision of an engine analyzer of the type set forth, which permits acquisition of cylinder waveform signals with the use of a single pickup lead.

Still another feature of the invention is the provision of a method of analyzing the operation of a multi-cylinder internal combustion engine with a direct, coil-per-cylinder ignition system.

In connection with the foregoing feature, a further feature of the invention is the provision of a method of the type set forth, which permits simultaneous display of waveform data acquired asynchronously from several cylinders, wherein "asynchronously," as used herein, means acquiring the waveforms for different cylinders from different engine cycles.

Certain ones of these and other features of the invention may be attained by providing a computer routine for use in an analysis apparatus of the type for analyzing the operation of a multi-cylinder internal combustion engine having an ignition coil with primary and secondary windings, wherein the apparatus includes waveform acquisition circuitry including primary and secondary pickup leads for respectively acquiring primary and secondary analog input waveform signals from primary and secondary coil windings and generating waveform data representative of such analog waveform signals, a memory for storing the waveform data, a user input device for inputting cylinder identifications, a display device having a display screen for displaying the waveform data, and a control processor coupled to the waveform acquisition circuitry and the memory and the input device and the display device. The computer routine is executed by the processor to permit use of a single pickup lead of the apparatus for analyzing ignition waveforms of direct ignition engines wherein each cylinder has its own ignition coil, the computer routine comprising: (a) a first portion, for establishing in the memory, cylinder buffers respectively associated with the cylinders of the engine under test; (b) a second portion for storing waveform data acquired from a cylinder by the single pickup lead in the cylinder buffer associated with that cylinder; and (c) a third portion for displaying on the display screen waveform data from any cylinder buffers in which such data has been stored.

Other features of the invention may be attained by providing a method of analyzing the operation of a multi-cylinder, direct ignition, internal combustion engine wherein each cylinder has its own ignition coil with primary and secondary windings, the method comprising the steps of: asynchronously acquiring analog waveform signals from a winding of each coil using a single pickup lead sequentially connected to the coils one cylinder at a time, generating digital waveform data from the acquired analog waveform signals and storing the data so that the data for each cylinder can be distinguished from the data for other cylinders, and displaying waveform data for any cylinders for which such data has been stored.

The invention consists of certain novel features and a combination of parts hereinafter fully described, illustrated in the accompanying drawings, and particularly pointed out in the appended claims, it being understood that various changes in the details may be made without departing from the spirit, or sacrificing any of the advantages of the present invention.

BRIEF DESCRIPTION OF THE DRAWINGS

For the purpose of facilitating an understanding of the invention, there is illustrated in the accompanying drawings a preferred embodiment thereof, from an inspection of which, when considered in connection with the following description, the invention, its construction and operation, and many of its advantages should be readily understood and appreciated.

DESCRIPTION OF THE PREFERRED EMBODIMENT

Figure 1:
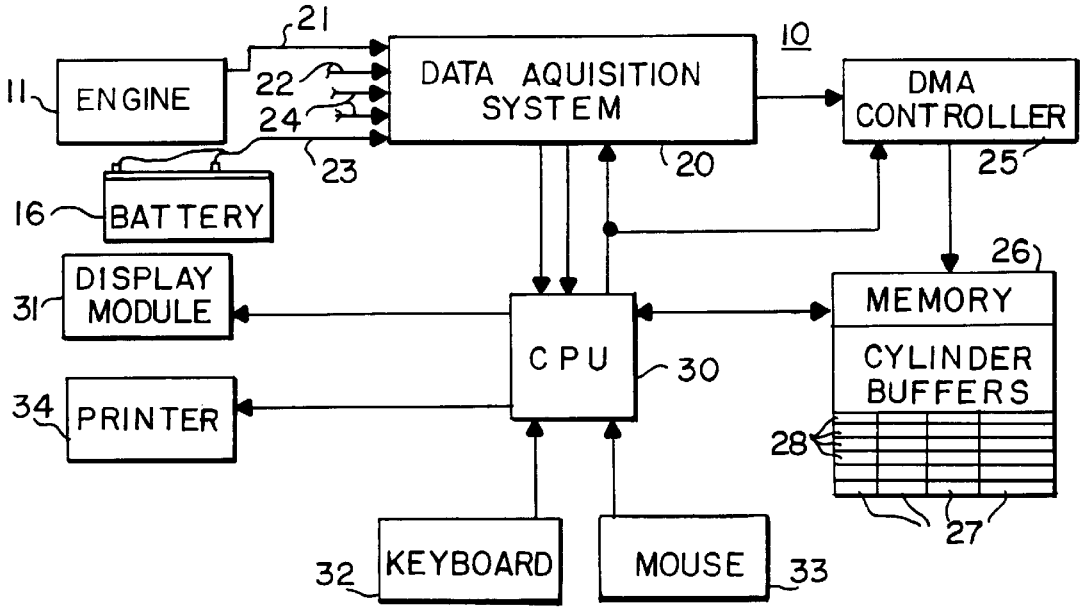
FIG. 1 is a functional block diagram of an engine analyzer incorporating a digital display device in accordance with the present invention and shown connected to an engine under test.

Referring to FIG. 1, there is illustrated an engine analyzer, generally designated by the numeral 10, in accordance with the present invention. The engine analyzer 10 is adapted for analyzing the operation of an associated multi-cylinder internal combustion engine 11 by, inter alia, monitoring analog waveform signals generated by the engine 11.

Figure 2:
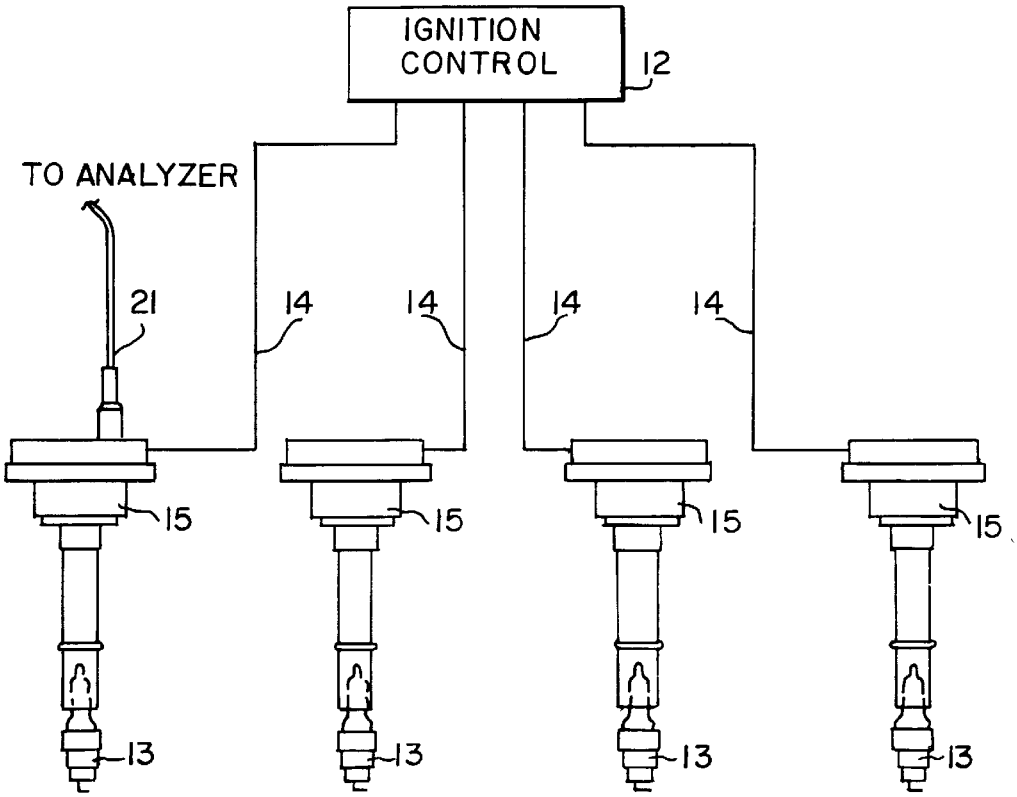
FIG. 2 is a diagrammatic illustration of a portion of the direct, coil-per-cylinder ignition system of the engine of FIG. 1, with the primary pickup lead of the engine analyzer of FIG. 1 coupled to the coil tower of one of the cylinders.

Referring to FIG. 2, the engine 1 has a direct, coil-per-cylinder ignition system which includes an ignition control 12 to control the application of firing voltages to the spark plugs 13 of the several cylinders of the engine 11. For purpose s of illustration, FIG. 2 shows a four-cylinder engine, but it will be appreciated that the principles of the present invention are applicable to engines with any number of cylinders. In the direct ignition system of FIG. 2, control, voltages are applied via conductors 14, respectively to coil towers 15 which are connected, respectively, to the spark plugs 13. Each coil tower 15 includes a coil having a primary winding to which the associated conductor 14 is connected and a secondary winding which is connected to the spark plug 13, all in a known manner. The system is powered by an automotive battery 16, typically a 12-VDC battery (FIG. 1), also in a known manner.

In order to acquire input waveform signals from the engine 11, the analyzer 10 is provided with a plurality of signal pickup leads which are adapted for connection to selected points in the engine 11. Among the pickup leads are primary and secondary leads 21 and 22 designed, respectively, for acquisition of primary and secondary signals from an ignition coil, with or without the use of appropriate adapters (not shown) provided with the analyzer 10, depending upon the type of engine and ignition system under test. The analyzer 10 also includes a twinflex lead 23 adapted for connection to the terminals of the battery 16. While the lead 23 is not essential to the operation of the present invention, it will typically be connected in normal use to assure a good ground for the system. Other pickup leads 24 are also typically provided, which may include a no. 1 cylinder probe for coupling to the spark plug wire for the no. 1 cylinder for sync purposes, in a known manner. While only two of the additional pickup leads 24 have been illustrated, it will be appreciated that other auxiliary leads may also be provided for acquiring other signals, including non-ignition related signals, which auxiliary leads may include general-purpose voltage pickup probes, in a known manner. As will be explained in greater detail below, it is a significant aspect of the present invention that only a single one of the pickup leads, viz., either the primary lead 21 or the secondary lead 22, is required for operation of the system in accordance with the invention.

The signal pickup leads 21–24 are coupled to a data acquisition system (DAS) 20, which may include suitable signal conditioning circuits and trigger detection circuits, and also includes an analog-digital converter (ADC) for digitizing the analog input waveform signals to generate digital waveform data, all in a known manner. The waveform data is applied to a direct memory access (DMA) controller 25 which, in turn, controls the storage of waveform data in a memory 26. As will be explained in greater detail below, the present invention establishes in the memory 26 a plurality of cylinder buffers 27, equal in number to the cylinders of the engine 11 under test, with each buffer including a plurality of waveform storage cells 28, each arranged to store waveform data from a single firing cycle of the associated cylinder, wherein the firing cycle is the time between consecutive firings of the same cylinder.

The analyzer 10 is provided with a suitable central processing unit (CPU) 30, which may be in the form of a microprocessor, which is coupled to the DAS 20, the DMA controller 25 and the memory 26. The CPU 30 receives interrupts from the DAS 20 and controls the sampling of the analog waveform by the ADC and also controls the operation of the DMA controller 25 for controlling the writing of waveform data to the memory 26. The CPU 30 also controls the transfer of stored waveform data from the memory 26 to a display module 31, which is preferably a color oscilloscope display operable with various sweeps and various types of triggering in single or dual-trace modes. User selection of these modes and other parameters is effected through an appropriate user interface, which may include a keyboard 32 and/or a mouse 33, as well as other devices such as a remote control unit, all coupled to the CPU 30. The analyzer may also be provided with a printer 34 coupled to the CPU 30 for creating a permanent record of data stored in the memory 26 and/or displayed on the display module 31, in a well-known manner.

The display module 31 is provided with a plurality of different fixed-time sweeps and the usual cylinder, parade and raster engine sweeps, commonly available in prior engine analyzers. The display module 31 is preferably also provided with 5 ms engine sweeps, described in greater detail in the aforementioned application Ser. No. 08/630,382, which are similar to standard engine sweeps except that only the first 5 ms of each cylinder waveform is displayed. There are 5 ms engine sweeps corresponding to each of the standard engine sweeps, viz., cylinder 5 ms, parade 5 ms and raster 5 ms.

The engine analyzer 10 supports all of the three standard types of triggering for digital display scopes in engine analyzers, viz., cylinder triggering, automatic triggering and signal triggering. Engine sweeps and 5 ms engine sweeps use cylinder triggering. Fixed-time sweeps use either automatic or signal triggering, as is standard in prior art digital engine analyzers, and can also use cylinder triggering, as disclosed in copending application Ser. No. 08/629,813, filed Apr. 10, 1996, entitled "Engine Analyzer with Cylinder Triggering of Oscilloscope Display Having Fixed-Time-Sweep, now U.S. Pat. No. 5,941,926."

Summarizing the invention, a "pseudo" parade waveform is generated in order to view multiple cylinders simultaneously. This is accomplished by using a single probe to separately acquire and save, one cylinder at a time a set of waveforms for each of the cylinders. These cylinder waveforms are then combined in a display similar to a conventional parade pattern. The result is a "pseudo" parade because the waveform for each cylinder is obtained from a different engine cycle, whereas in a "true" parade the waveforms for all cylinders are obtained from the same engine cycle. Despite this drawback, this pseudo parade can be useful because it allows a mechanic to simultaneously view and compare the waveforms for multiple cylinders. A "pseudo" raster pattern (with the cylinder waveforms stacked one above the other) can also be generated, but is not discussed further here for the sake of simplicity.

Each cylinder is allocated a waveform storage buffer in the memory 26, wherein each buffer consists of a circular array of storage cells. Each cell stores at least a portion of one cylinder waveform, i.e., the waveform for a single firing cycle of the cylinder. The DAS is configured by the program to sample only the first five milliseconds of the waveform for each cylinder, and to store the data in a temporary buffer by means of DMA control. At the end of each cylinder cycle (marked by a spark), the DAS generates an interrupt, which invokes an interrupt service routine ISR. The ISR takes the data from the temporary buffer and, after some processing, saves the data in the next available storage cell of the waveform buffer for the current cylinder. The current cylinder is the cylinder to which the pickup lead is currently connected, as indicated by a cylinder selection icon, which is described below.

In the illustrated embodiment, the primary pickup lead 21 is connected to the primary winding of the coil tower 15 for the no. 1 cylinder. While the following discussion is all in the context of a primary ignition waveform, it will be appreciated that the discussion applies equally well to secondary waveforms, which would be acquired by use of the secondary pickup lead 22.

While the primary pickup lead 21 is connected to the no. 1 cylinder, the desired portion of each cylinder firing waveform is stored in a corresponding cell 28 of the buffer 27 for that cylinder. In the preferred embodiment, the waveform data will be displayed with a 5 ms engine sweep and, therefore, only the first 5 ms of each waveform is acquired and stored. After a sufficient number of firings of the first cylinder have been stored, the user selects the next cylinder in the firing order by use of the keyboard 32 or mouse 33, the pickup lead 21 is shifted to the primary winding of the coil tower for that next cylinder and the process is repeated until waveform data for all cylinders has been stored. The system permits not only the display of waveform data for the cylinder to which the pickup lead 21 is currently connected, but also the simultaneous display of waveform data for all cylinders for which such data has been stored.

Figure 3:
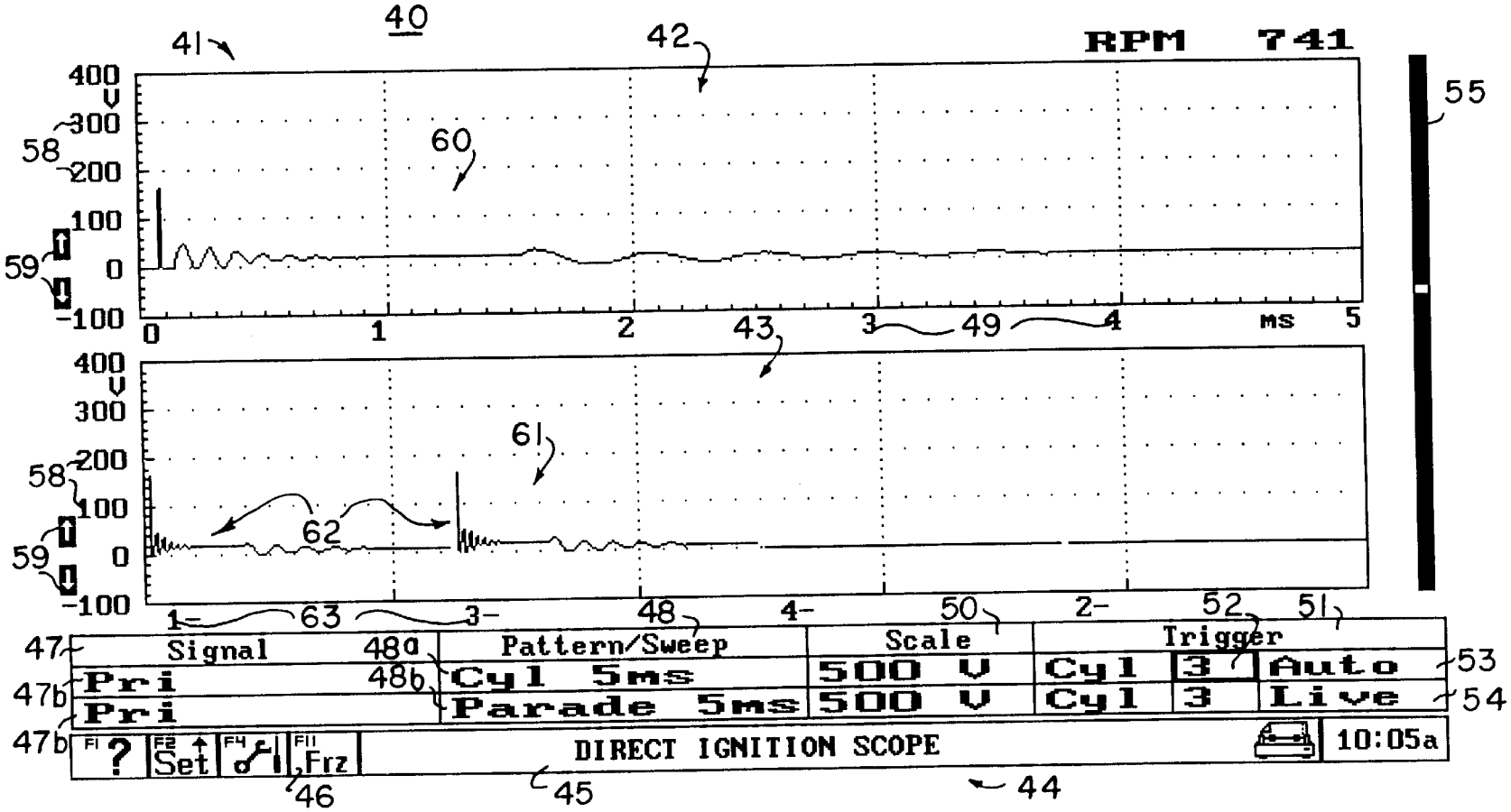
FIGS. 3–5 are screen displays obtainable with the engine analyzer of FIG. 1.

Referring now to FIG. 3, there is illustrated a screen display 40, which is available with the engine analyzer 10 for analysis of direct ignition engines and which will be useful for explaining significant aspects of the invention. While the display module 31 is operable in either single or dual-trace modes, the screen display 40 is set up in a dual-trace display mode, so that it has a waveform plot area 41 divided into an upper trace section 42 and a lower trace section 43. Displayed below the waveform plot area 41 is a control panel area 44, including a number of icons and indicators in the nature of rectangular boxes in which text or other indicia may be displayed, the boxes being arranged in horizontal rows. In the lowermost row is a scope test page indicator 45, which indicates the selected scope test page, in this case "Direct Ignition Scope," which is used for analysis of direct ignition engines. Alongside the scope test page indicator 45 is a Freeze icon 46, described more fully below, for toggling between Freeze and non-Freeze modes.

The control panel area 44 also includes a Signal icon 47, which includes boxes 47*a* and 47*b* for selecting and indicating the sources of the signals displayed in the two traces of the scope. In this case, since only a single input lead is utilized, both traces will necessarily display signals from the same source, in the illustrated embodiment the primary ignition signal. There is also a Pattern/Sweep icon 48 which indicates the sweep of the waveforms displayed in the two traces. It has been found that the most desirable sweep is a 5 ms sweep for analysis of direct ignition engines and, therefore, the system has dedicated the upper trace to a cylinder 5 ms display, which displays the first 5 ms of the waveform of the single cylinder currently being acquired, while the lower trace has a Parade 5 ms pattern which shows the first 5 ms of the primary waveform for each of the cylinders of the engine for which data has been stored, in a pseudo parade pattern. Time indicia 49 in milliseconds are arranged along the bottom of the upper trace section 42.

There is also a Scale icon 50, which selects and indicates the scales of the plot areas for each of the trace sections 42 and 43 along the vertical axis. In this case, since a primary signal is being acquired, a 500-volt scale is illustrated for both traces, although different scales could be used for either trace.

The control panel area 44 also includes a Trigger icon 51, which includes a box 52 for selecting and indicating the number of the cylinder from which the triggering is currently being acquired which, in this case, is necessarily the cylinder to which the primary pickup lead 21 is currently connected, since it is the only pickup lead being used. The type of triggering is indicated in box 53. This is selectable among "Primary, " "Secondary" and "Auto" triggering, for respectively deriving the trigger from the primary signal, the secondary signal or the best available one of the two. While, in the illustrated embodiment, Auto triggering has been selected, the trigger must necessarily be obtained from the primary signal, since that is the only one being acquired.

The Trigger icon 51 also includes a box 54 to indicate the current acquisition mode, which is selectable between Live and Saved. In the Live mode, illustrated in FIG. 3, the waveform displayed on the upper trace is the one currently being acquired. In the case of FIG. 3 it is the primary waveform from cylinder no. 3 and, more specifically, the most recently stored firing cycle for that cylinder. In this regard, the screen display 40 also includes a Memory Buffer icon 55 in the nature of a narrow, vertical box arranged along the right-hand side of the waveform plot area 41 which, in the Live display mode illustrated in FIG. 3, illustrates by the darkened area the portion of the waveform memory buffer for the selected cylinder which is filled. The cells 28 of the buffer 27 (FIG. 1) are arranged in a "circular" array, so that once all the cells of a buffer are filled, further incoming waveform data overwrites the oldest previously saved waveform data in the buffer. In FIG. 3, the entire icon is darkened, showing that all of the cells of the cylinder no. 3 buffer have been filled (starting at the bottom), a light marker 56 indicating the location of the cell into which the waveform data is currently being stored and, therefore, the portion of the buffer which has already been overwritten. In the Live mode, it is always the waveform data from the last-stored cell 28 which is being displayed.

Scale indicia 58 are arranged along the left-hand side of the trace sections 42 and 43 in increments appropriate to the selected scale. A 500-volt scale is illustrated for acquisition of a primary signal. If a secondary signal were being acquired a higher voltage scale, such as a 10-kv scale, would be utilized. The zero level of the illustrated scale is set so that the scale goes from −100 volts to 400 volts. The location of the zero level can be selectively changed by use of the control arrows 59.

In the upper trace section 42 there is displayed a waveform 60 for the cylinder currently being acquired, in this case cylinder no. 3. More specifically, the waveform 60 shows the first 5 ms of the last-stored firing cycle of cylinder no. 3. The display routine periodically displays the most recently saved waveform for the current cylinder on the upper trace section 42.

In the lower trace section 43 there is displayed a "pseudo" parade pattern 61 of waveforms 62 comprising the first 5 ms of the primary signal waveform for each cylinder for which data has been stored to date in the firing order, which is indicated by the cylinder markers 63 along the bottom of the lower trace section 43. More specifically, in the case of FIG. 3, since cylinder no. 3, which is the second cylinder in the firing order, is currently being acquired, the waveform 60 includes primary patterns for only cylinders 1 and 3 and, more specifically, the last-stored firing cycle for each of those cylinders. Thus, the cylinder 3 portion of the pattern 61 periodically displays the last-stored cylinder cycle, just as in the upper trace section 42. Since no data has yet been stored for cylinders 4 and 2, the pattern 61 is a flat line in the area for those cylinders.

Most of the icons in the control panel area 44 represent switches, which can be operated by the user by means of either the keyboard 32, the mouse 33 or other user interface device. The icon box with respect to which a selection is to be made is first activated, activation being indicated on the screen by emphasizing the icon. Emphasis is indicated by a thickened or brightened border around the box. Thus, in FIG. 3, the Cylinder box 52 is emphasized. With the keyboard 32, the arrow keys are used to shift the activation and emphasis to the appropriate box and then the "+" and "−" keys are used to index forwardly or rearwardly through the options within the emphasized box. In order to activate a box not already activated with the mouse 33, the mouse is clicked once on the box. Then, each subsequent click of the mouse button on the emphasized icon will index the switch one option forward. Alternatively, the mouse button can be held down, locking the mouse cursor within the emphasized box, and the mouse is then moved up and down to scroll the available options through the emphasized box. The Freeze icon 46 is a toggle-type switch, toggling between Freeze and non-Freeze modes, the former being indicated by a reverse display of the icon, as in FIG. 5.

While the above-described switch selection techniques are used in the preferred embodiment, it will,be appreciated that the engine analyzer 10 can be programmed so that switch selections can be made with other combinations of operations of the keyboard 32 and/or the mouse 33.

Figure 4:
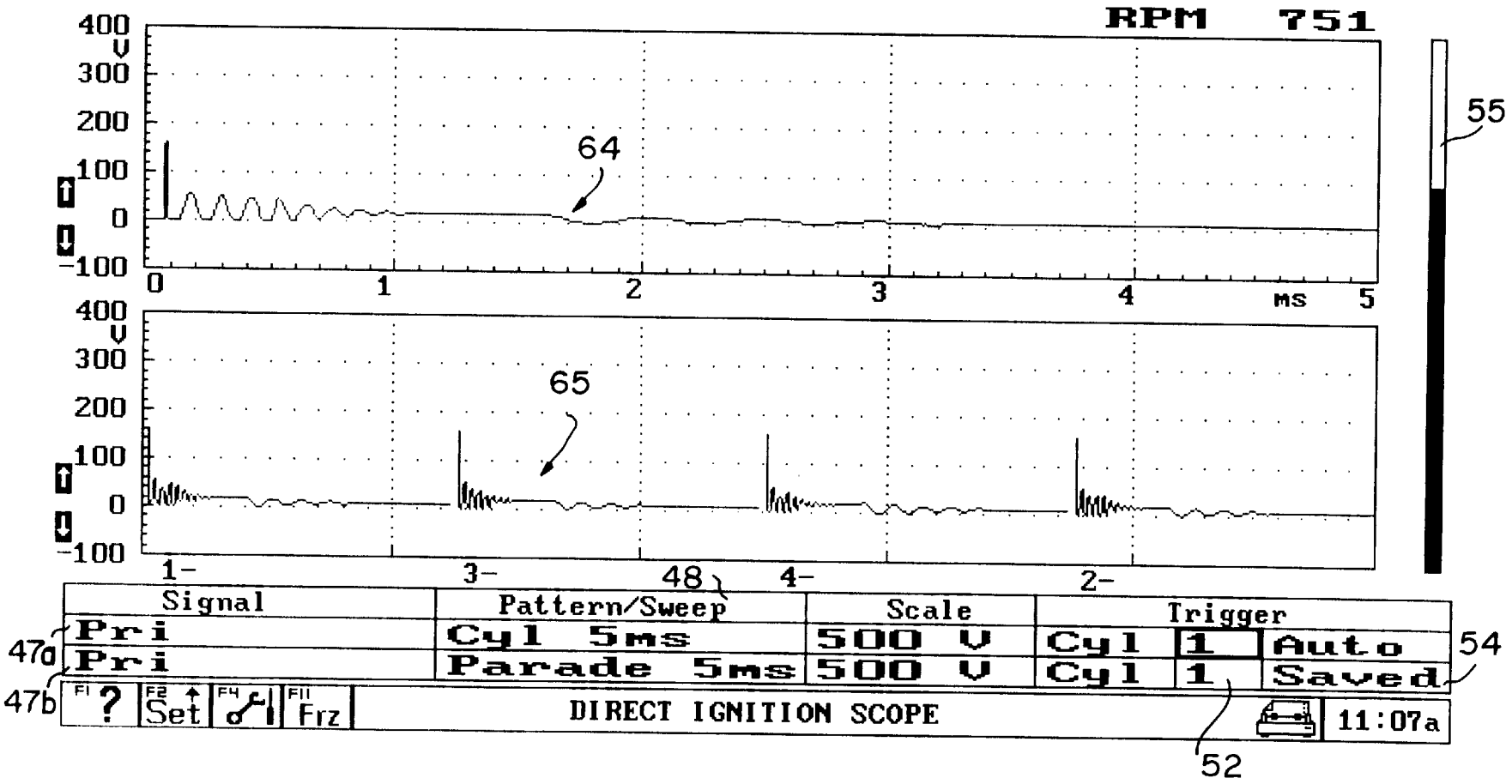

Referring to FIG. 4, there is illustrated a screen display which is similar to the screen display of FIG. 3, except in this case waveform data for all four cylinders has been acquired and the system is in the Saved mode, as indicated in the icon box 54. In the Saved mode data acquisition stops, but the two traces continue to display the last-stored waveform for the appropriate cylinders. Thus, a pattern 64 comprising the last-stored waveform for the current cylinder is displayed in the upper trace section 42, while the lower trace section 43 displays a pattern 65, which includes the last-stored waveform for each of the four cylinders.

The Saved mode can be entered in two ways. First, while. the system is operating in the Live mode, the user can select the Saved mode by switching the icon box 54 by the use of the keyboard 32 or mouse 33. In this case, all of the other icons and indicators remain the same and the two trace sections 42 and 43 continue to display the same waveform patterns they were displaying just before the Saved mode was entered. Second, while in the Live mode, if the user changes cylinders by switching the cylinder icon 52, and waveform data has already been stored in the buffer 27 corresponding to the newly-selected cylinder, the system will automatically switch to the Saved mode, changing the icon box 54 accordingly. Thus, the user is given an opportunity to consider whether he really wants to acquire new data for that cylinder. In FIG. 4, the mode box 54 is highlighted showing "Saved" mode selected and the buffer icon 55, which always shows the condition of the buffer for the current cylinder (i.e., the cylinder selected in the Cylinder box 52), indicates it is about half full.

It is significant to note that in the present invention, with only a single pickup lead connected to the engine, the analyzer 10 has no way of knowing which cylinder's data is currently being acquired, except by the cylinder selection entered by the user in the Cylinder box 52. Thus, referring to FIG. 4 where cylinder 1 is selected, if the user intends to collect data from that cylinder, he must move the pickup lead 21 from the cylinder to which it was previously connected to cylinder no. 1 before switching back to the Live mode. Otherwise, the system will start storing in the cylinder no. 1 buffer data from some other cylinder. It is up to the user to make sure that the cylinder selection on the control panel 44 and the pickup lead connection correspond.

If, while operating in the Live mode, the user switches the cylinder selection on the control panel 44, and there is no data stored in the buffer for the newly-selected cylinder, the system will remain in the Live mode and immediately start storing data in that newly-selected buffer. However, it will not be data from the selected cylinder, since the pickup lead 21 remains connected to the previously-selected cylinder. Thus, if the user has switched cylinders because he now intends to collect data from the newly-selected cylinder, after he switches the pickup lead to the newly-selected cylinder he must be sure to collect data long enough to clear out the wrong-cylinder data which had accumulated in the newly-selected buffer before he switched the pickup lead. Alternatively, when he intends to start acquiring data from a new cylinder, the user could first select the Saved mode, stopping data acquisition, then switch the pickup lead to the new cylinder from which he intends to collect data, and then switch the cylinder on the control panel to the new cylinder number. The system will then automatically return to the Live mode, and will start storing data from the new cylinder into the correct buffer.

Note that in a non-Freeze mode the Cylinder boxes 52 for the two trace sections will always show the same cylinder, which is the currently-selected cylinder. However, in the Freeze mode the Cylinder indications have a different significance, as will be explained below.

Figure 5:
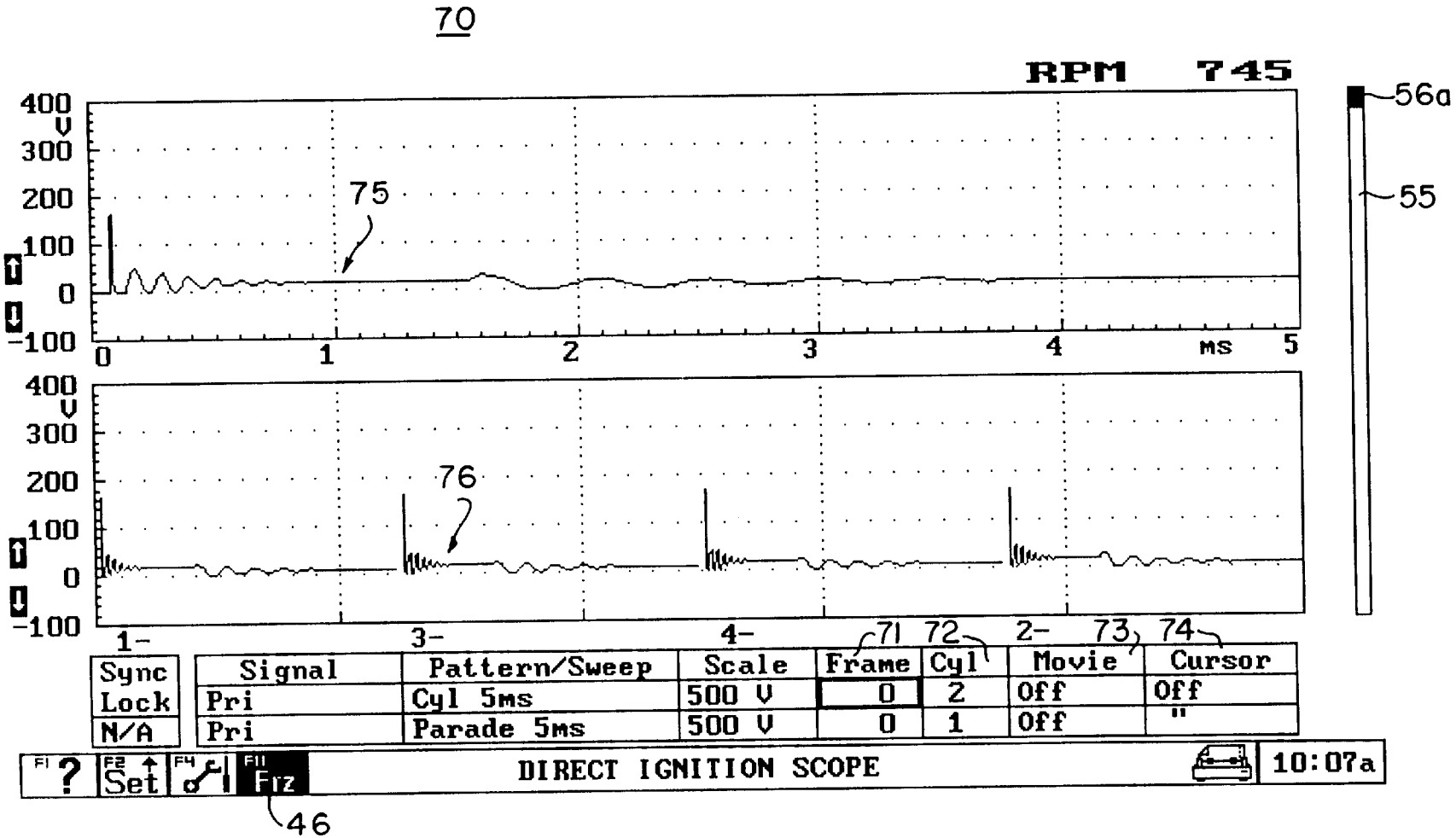

Referring now to FIG. 5, there is illustrated a screen display 70 which results when the user selects the Freeze mode. This mode may be selected by "clicking" on the Freeze icon 46, which becomes highlighted when the Freeze mode is selected, as indicated in FIG. 5, and is unhighlighted when that mode is de-selected. The Freeze mode terminates data acquisition and permits the user to review waveform data stored in any of the cylinder buffers. In the screen display 70 the control panel area 44 is somewhat modified.

There is now provided a Frame icon 71 which indicates the particular cell 28 of each buffer 27 from which waveform data is being displayed. When the Freeze mode is entered the cells of each buffer are numbered from the last-stored frame to the earliest-stored frame starting with zero for the last-stored frame and assigning sequential negative numbers to the others, and the Frame icon 71 defaults to the zero frame. There is also a Cylinder icon 72, the upper box of which indicates the cylinder buffer 27 in which the waveform displayed in the upper trace section 42 is stored, and the lower box of which indicates the first cylinder in the parade pattern in the lower trace section 43. The buffers are numbered from one to the number of cylinders in the engine under test and, when the Freeze mode is selected, the upper box of the Cylinder icon 72 defaults to the no. 1 cylinder. Thus, the cylinder 2 indication shown in FIG. 5 must have been selected after Freeze mode was entered. In the Freeze mode the Memory Buffer icon 55 has a different significance. Instead of showing how many of the buffer cells are filled, it indicates the particular buffer cell (frame) which is being displayed by means of a marker 56*a*, with the most recent or zero frame at the top of the icon.

There are also provided a Movie icon 73 an a Cursor icon 74, which will not be described in detail, since they are known in prior art engine analyzers and are not pertinent to the present invention. However, it is noted that when the Movie mode is off, as in FIG. 5, the system can only display one frame at a time, as selected by the user. Thus, in FIG. 5, the zero frame for cylinder 2 is displayed in a pattern 75 on the upper trace and the zero frame for each cylinder is shown in a pattern 76 on the lower trace. In Movie mode, the system can automatically continuously scroll through all of the frames in each buffer, displaying them one after another at either a fast or slow repetition rate or, if "All" is selected in the Movie icon 73, the system will display all of the frames superimposed on each cylinder. If a particular cylinder buffer has no data in the cell corresponding to the selected frame, a flat line trace is displayed for that cylinder buffer. Alternatively, the system could be programmed so that, when the Frame number selected is higher than the number of waveforms stored in a particular cylinder buffer, either nothing could be displayed or the waveform 76 could continue to display for that cylinder the waveform from the highest-numbered cell containing waveform data for that buffer.

In FIGS. 3–5 there are indicated certain other icons, indicators and markers which are not described herein, since they are not pertinent to the present invention.

Figure 6:
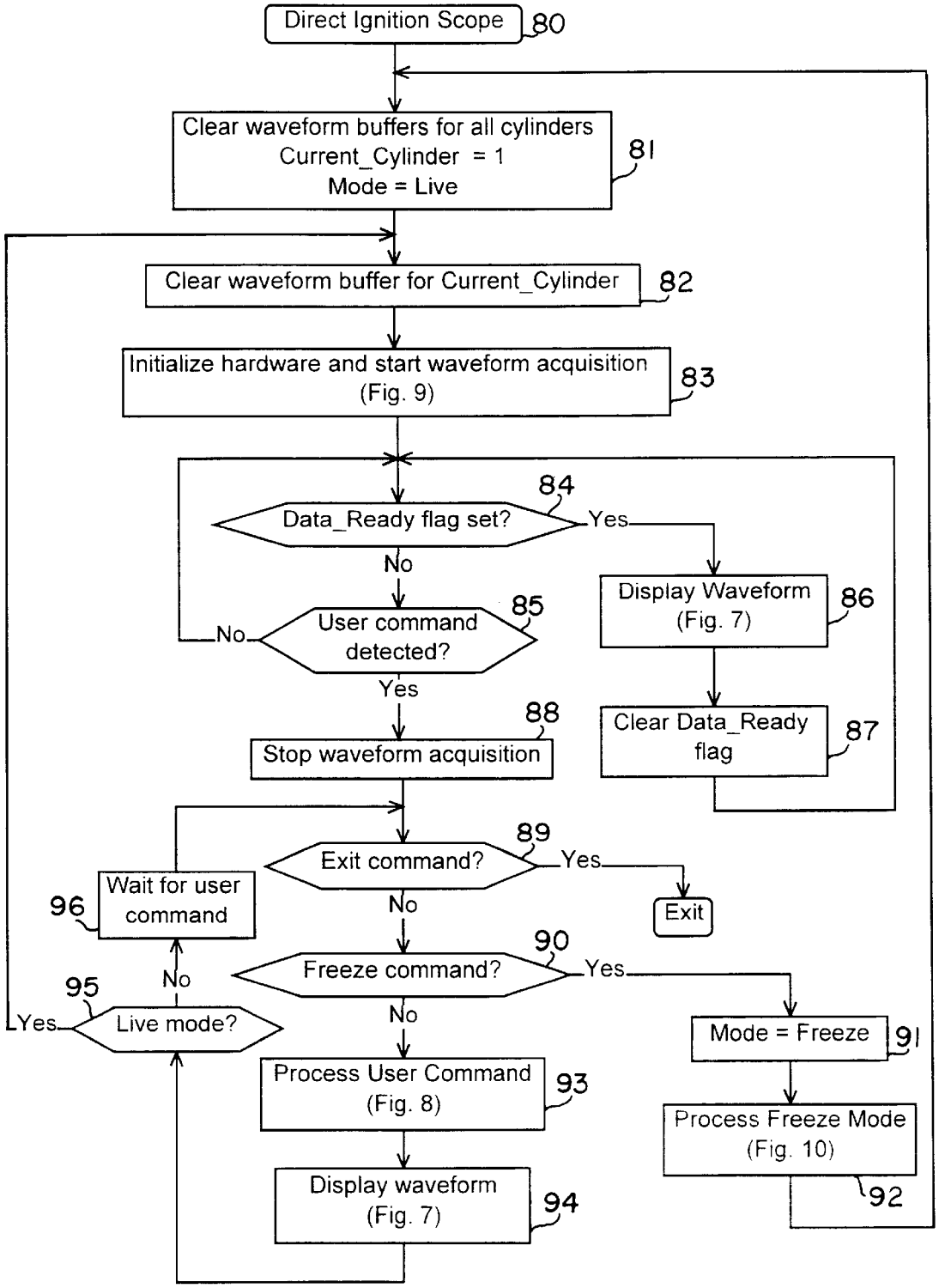
FIGS. 6–10 are flow chart diagrams of software program routines executed by the CPU of the engine analyzer of FIG. 1 for controlling the acquisition and display of ignition waveforms from the ignition system of FIG. 2 with the use of a single pickup lead.

Referring now to FIGS. 6–10, there are illustrated flow charts for the software routines executed by the CPU 30 in controlling the operation of the engine analyzer 10 in accordance with the present invention. Referring to FIG. 6, when the Direct Ignition Scope mode is initially entered (from a main menu screen, not shown) a main routine 80 is initiated, and a screen display like that of FIG. 3 will be displayed. The Signal and Scale icons 47 and 50 and the Trigger icon box 53 will display whatever selections had been made for these parameters the last time the Direct Ignition Scope mode was exited. The routine will, at 81, clear the waveform buffers 27 for all cylinders, set a Current_Cylinder parameter equal to 1, setting the Cylinder icon 52 accordingly, and set the Mode parameter to Live, setting the mode box 54 accordingly. Then, at 82, the routine clears the waveform buffer for the Current_Cylinder. Then, at 83, the routine initializes the hardware and starts 5-ms engine waveform acquisition in accordance with a subroutine illustrated in FIG. 9, to be discussed more fully below. In that subroutine, each time a frame of data is stored in its corresponding buffer cell 28, a Data_Ready flag is set.

The main routine next, at 84, checks to see whether or not the Data_Ready flag is set. It will not be if data acquisition has just started, so the routine checks at 85 to see if a user command (effected by the keyboard 32 or mouse 33) has been detected and, if not, returns to 84 to continue waiting for storage of a cylinder waveform. If, at 84, the Data_Ready flag is set, the routine displays the stored waveform at 86 in accordance with a routine illustrated in FIG. 7, to be explained more fully below, then clears the Data_Ready flag at 87 and returns to 84. Since the Data_Ready flag was just cleared, the decision at 84 is now "No, " so the program again checks for a user command at 85 and continues as before to look for the next waveform storage. The system will continue in this manner, displaying each new cylinder cycle waveform, as it is stored, until a user command is entered.

When a user command is detected at 85, the program drops to 88 and stops waveform acquisition and then proceeds to ascertain the nature of the user command. More specifically, the routine checks at 89 to see if it is an Exit command and, if so, exits the Direct Ignition Scope mode. If not, it checks at 90 to see if it is a Freeze command. If so, it sets the Mode parameter to Freeze at 91, highlighting the Freeze icon 46 and bringing up the Freeze screen display of FIG. 5, then processes the Freeze mode at 92 in accordance with a subroutine illustrated in FIG. 10 to be described more fully below, then, when Freeze mode is exited, returns to 81. If, at 90, the Freeze command was not detected, the program. processes the other user commands at 93 in accordance with a routine illustrated in FIG. 8, then displays the waveforms in accordance with the routine of FIG. 7 at 94, then checks at 95 to see if the system is in the Live mode. If it is, it returns to 82 to clear the waveform buffer 27 for the Current_Cylinder. If not, then it is in the Saved mode land waits at 96 for a further user command and then returns to 89.

Figure 7:
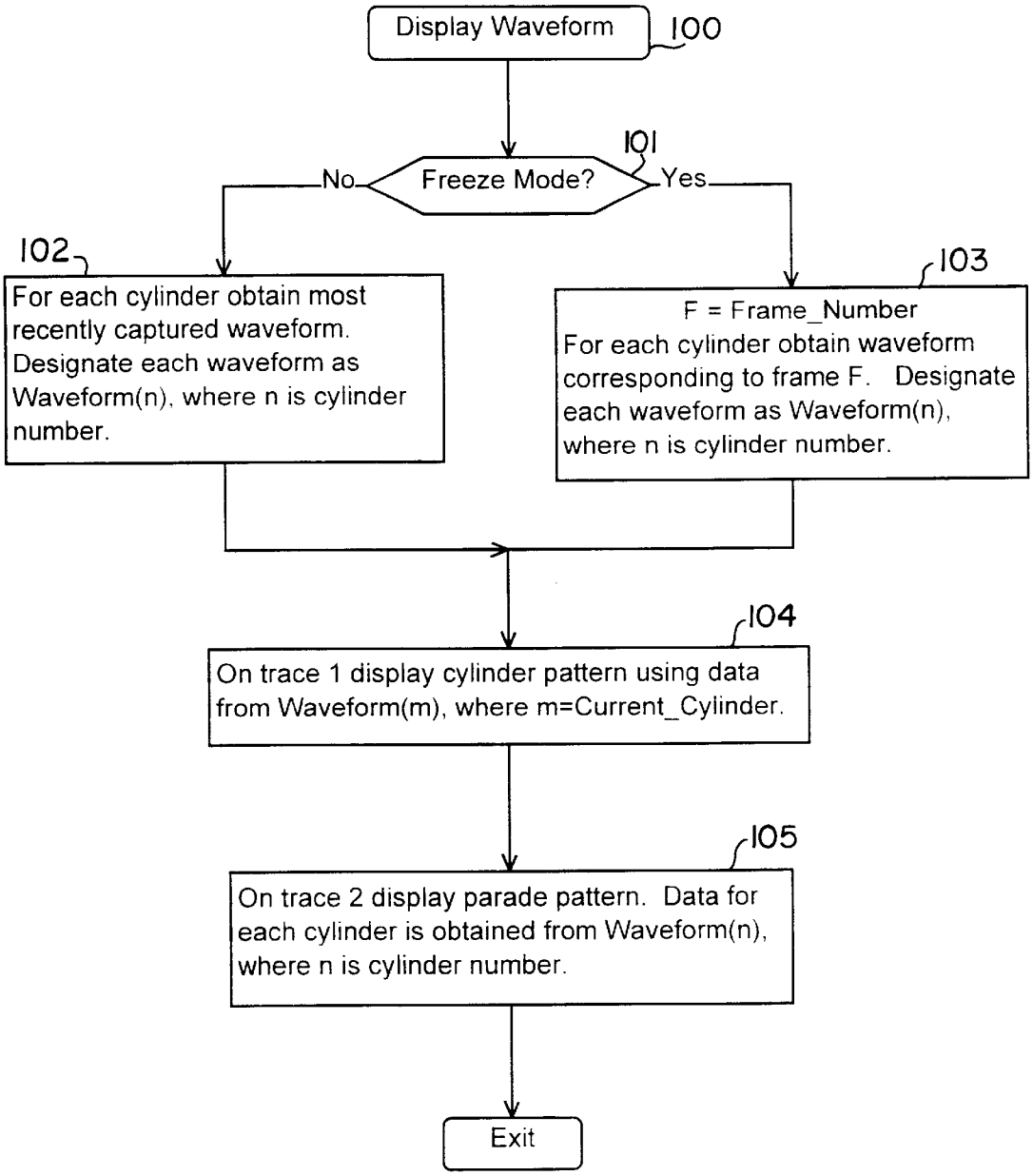

Referring to FIG. 7, the Display Waveform routine 100 is illustrated. When this routine is called, it first checks at 101 to see if the system is in the Freeze mode. If it is not, such as when the routine was called from 86 or 94 of FIG. 6, it moves to 102 and, for each cylinder, obtains the most recently captured waveform and designates each such waveform as Waveform(n), where n is the cylinder number corresponding to the buffer from which the waveform was obtained. If, at 101, the system is in the Freeze mode, the routine moves to 103 and sets F=Frame_Number, where Frame_Number is the number selected in the Frame icon 71. As was indicated above, when the Freeze mode is first entered, this number defaults to zero. Then, for each cylinder, the routine obtains the waveform from the buffer cell 28 corresponding to frame F and then designates each such waveform as Waveform(n), where n is the cylinder number corresponding to the buffer 27 from which the waveform was obtained.

From either 102 or 103 the routine then moves to 104 to display on trace 1 a cylinder pattern utilizing the waveform data from Waveform(m), where m is the Current_Cylinder, i.e., the cylinder selected in the Cylinder icon 72. As was indicated above, when the Freeze mode is first entered, this number defaults to cylinder no. 1. Then, at 105,the routine displays on the lower trace a "pseudo" parade pattern, wherein the data for each cylinder is obtained from Waveform(n). It will be appreciated that, at 104 and 105, the waveform displayed will be either the waveform corresponding to frame F or the most recently captured waveform, depending upon whether the system is or is not in the Freeze mode. The routine is then exited.

Figure 8:
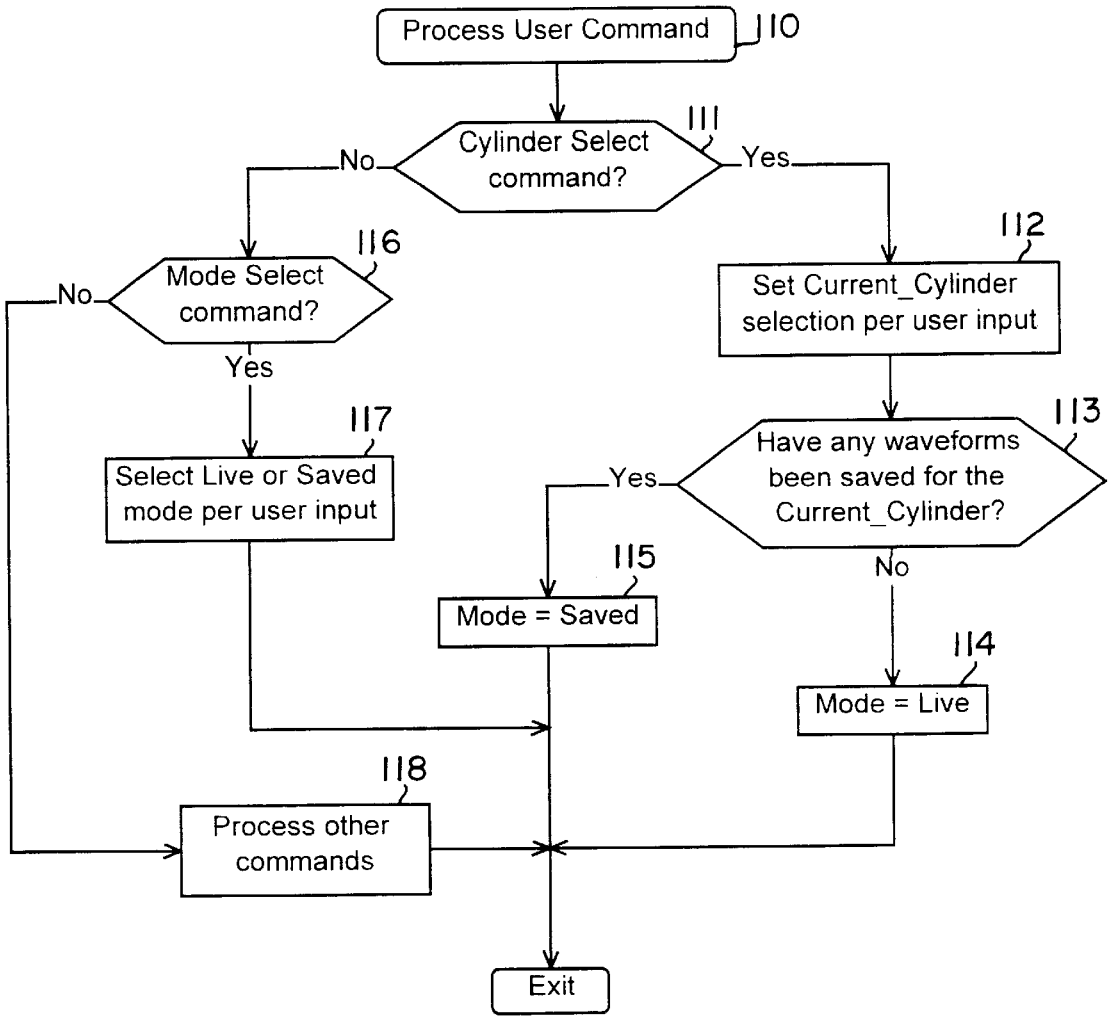

Referring to FIG. 8, there is illustrated the Process User Command routine 110, which is called, e.g., at 93 of FIG. 6. The routine first checks at 111 to see if the command was a Cylinder Select command. If so, it sets the Current_Cylinder selection in accordance with the user input at 112, setting the Cylinder box 52 of the Trigger icon 51 accordingly. Then, at 113, the routine checks to see if any waveforms have been'saved for that cylinder. If not, it sets the Mode to Live at 114 and, if so, sets the Mode to Saved at 115, setting the icon box 54, accordingly, and then exits.

If, at 111, the user command was not a Cylinder Select command, the program then checks at 116 to see if it was a Mode Select command and, if so, selects the Live or Saved mode per user input at 117, setting the icon box 54 accordingly, and then exits. If it was not a Mode Select command, the program proceeds to 118 to process the other possible user commands before exiting.

Figure 9:
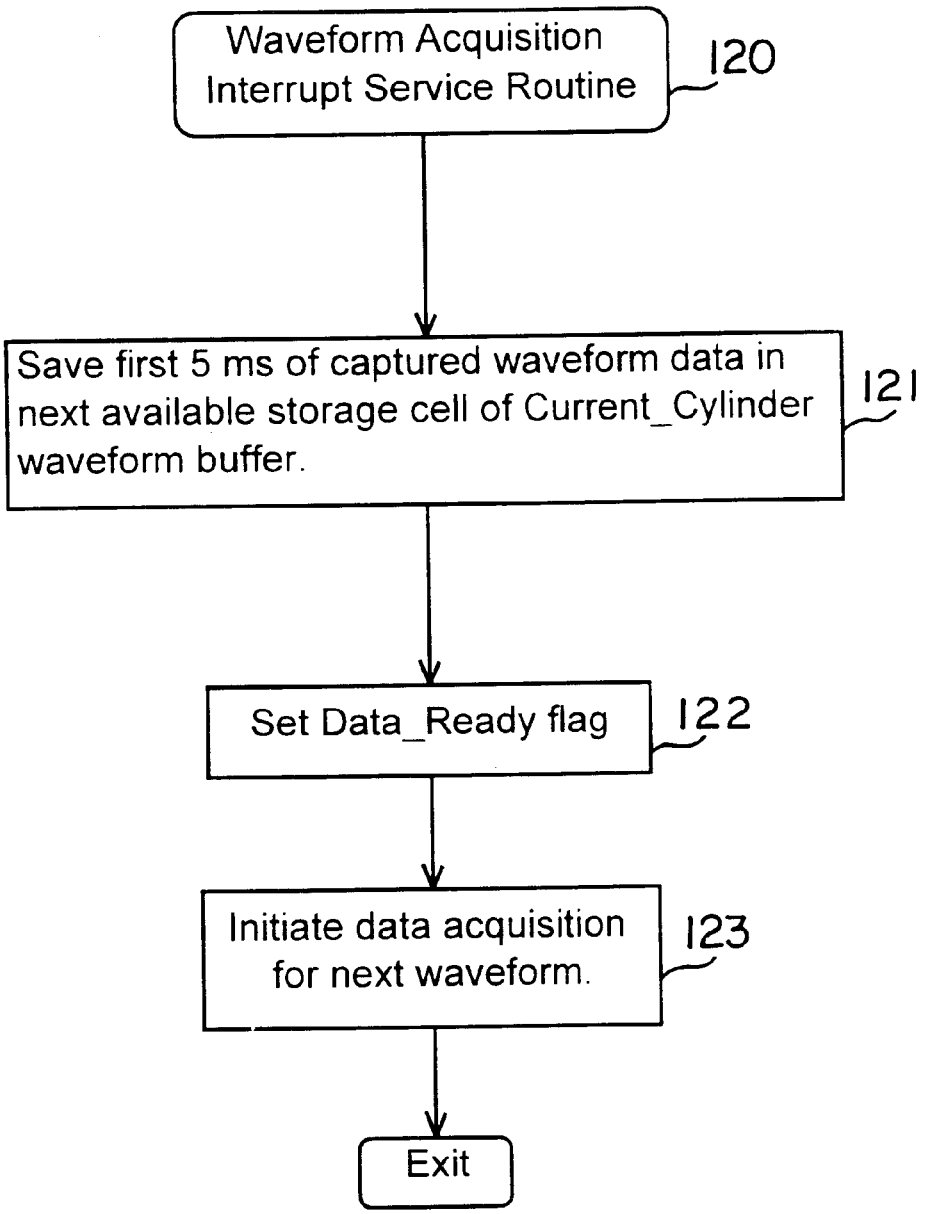

Referring to FIG. 9, the Waveform Acquisition Interrupt Service Routine 120 is illustrated. As was explained above, the DAS 20 is configured to sample the first 5 ms of the waveform for each cylinder, and to store the data in a temporary buffer by means of the DMA controller 25. At the end of each cylinder cycle (marked by a spark), the DAS 20 generates an interrupt, which invokes the interrupt service routine of FIG. 9. This routine operates at 121 to take the data from the temporary buffer and, after some processing, save it in the next available storage cell of the waveform buffer for the current cylinder, i.e., the cylinder to which the pickup lead 21 is currently connected, as indicated by the cylinder icon box 52. The routine then sets the Data_Ready flag at 122 and then, at 123, initiates data acquisition for the next waveform, and then exits.

Figure 10:
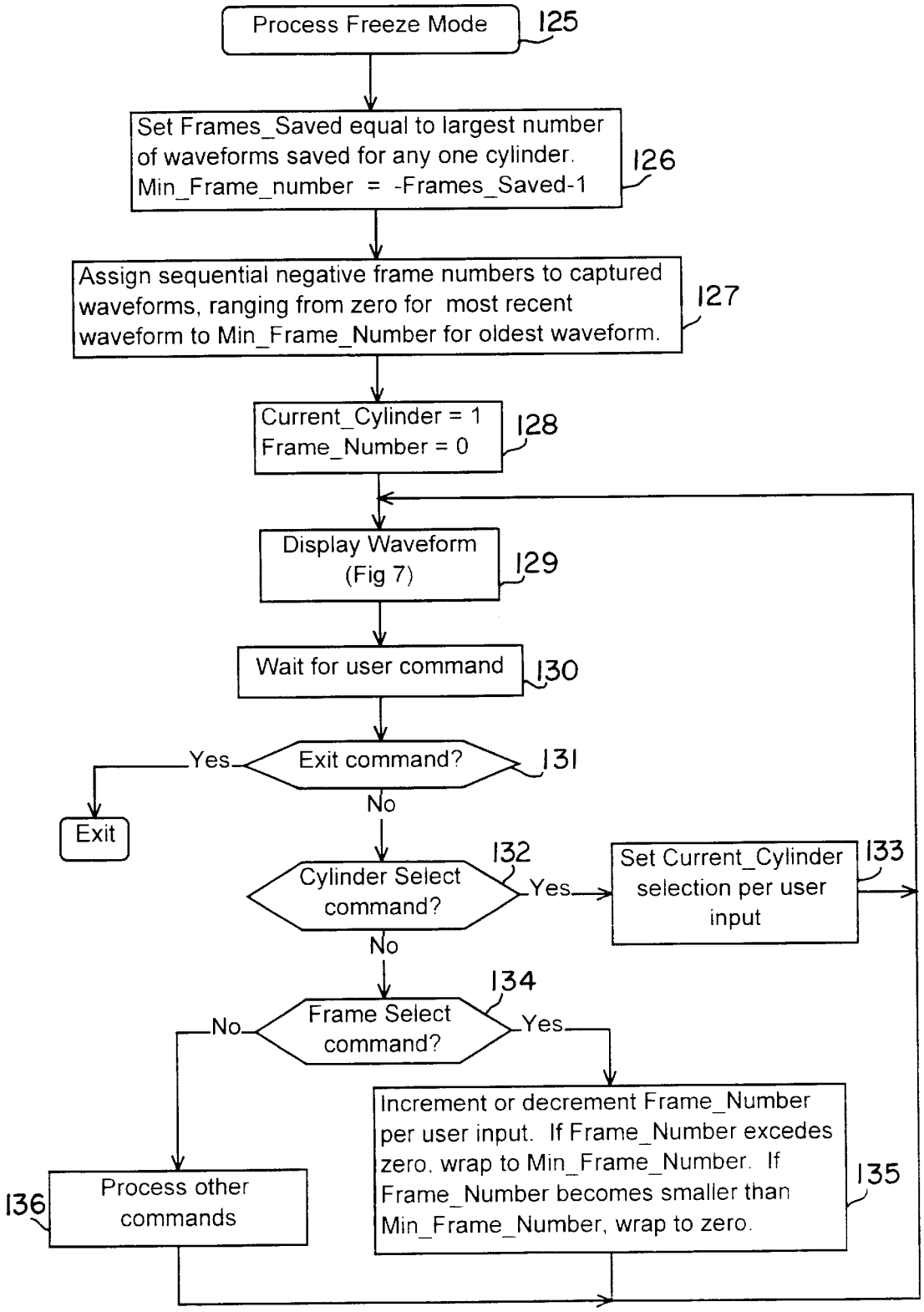

FIG. 10 illustrates the Process Freeze Mode routine 125, which is called at 92 of FIG. 6 in response to user selection of the Freeze mode by switching the icon 46 (FIG. 5). The routine first, at 126, sets Frames saved equal to the largest number of waveforms saved for any one cylinder. Thus, e.g., if 50 frames had been saved in the cylinder 1 buffer and 40 frames in each of the other cylinder buffers, Frames_Saved would be set equal to 50. Then Min_Number is set equal to −Frames_Saved−1. Then, at 127, the routine assigns sequential negative frame numbers to captured waveforms, ranging from zero for the most recently-acquired waveform to Min_Frame_Number for the oldest waveform.

Next, at 128, the routine defaults to Current_Cylinder equal to 1 and Frame_Number equal to zero and displays the waveform at 129 in accordance with the routine of FIG. 7, described above, and then waits for a user command at 130. If a command is received, the routine checks at 131 to see if it is an Exit command, i.e., a de-selection of the Freeze mode by switching the icon 46 and, if so, the routine is exited. If it is not an Exit command, the routine checks at 132 to see if it is a Cylinder Select command and, if so, at 133 sets the Current_Cylinder selection in accordance with the user input and then returns to 129 to again display the waveform for the selected cylinder and then again wait for the next user command.

If it is not a Cylinder Select command, the program checks at 134 to see if it is a Frame Select command and, if so, moves to 135 to increment or decrement Frame_Number in accordance with the user input. If Frame_Number exceeds zero it wraps to Min_Frame_Number and, if Frame_Number becomes smaller than Min_Frame_Number, it wraps to zero and then returns to 129 to display the waveform for the selected frame. If it was not a Frame Select command at 134, the routine moves to 136 to process the other possible commands (e.g. scale, zero level etc.) before returning to 129 to display the waveform in accordance with the user command.

In non-Freeze mode the Pattern/Sweep icon 48 is fixed, but it could be made user-selectable in the Freeze mode so that, for example, the user could select raster as well as parade patterns and could place the multi-cylinder pattern in the upper trace section 42 and the single-cylinder pattern on the lower trace section 43, since the manner of making such selection is well-understood and is disclosed, e.g., in copending U.S. application Ser. No. 08/629,484, filed Apr. 10, 1996 and entitled "System for Configuring Oscilloscope Screen in Freeze Mode."

From the foregoing, it can be seen that there has been provided an improved apparatus and method for analyzing direct ignition engines by acquiring data from; the several engine cylinders with the use of a single pickup lead, one cylinder at a time, and simultaneously displaying waveform data from multiple cylinders.

While particular embodiments of the present invention have been shown and described, it will be obvious to those skilled in the art that changes and modifications may be made without departing from the invention in its broader aspects. Therefore, the aim in the appended claims is to cover all such changes and modifications as fall within the true spirit and scope of the invention. The matter set forth in the foregoing description and accompanying drawings is offered by way of illustration only and not as a limitation. The actual scope of the invention is intended to be defined in the following claims when viewed in their proper perspective based on the prior art.

We claim:

1. In an analysis apparatus of the type for analyzing the operation of a multi-cylinder internal combustion engine having an ignition coil with primary and secondary windings, wherein the apparatus includes waveform acquisition circuitry including primary and secondary pickup leads for respectively acquiring primary and secondary analog input waveform signals from primary and secondary coil windings and generating waveform data representative of such analog waveform signals, a memory for storing the waveform data, a user input device for inputting cylinder identifications, a display device having a display screen for displaying the waveform data, and a control processor coupled to the waveform acquisition circuitry and the memory and the input device and the display device, the improvement comprising:

a computer routine executed by the processor to permit use of a single pickup lead of the apparatus for analyzing ignition waveforms of direct ignition engines wherein each cylinder has its own ignition coil said computer routine comprising:

(a) a first portion, for establishing in the memory, cylinder buffers respectively dedicated to the cylinders of the engine under test;

(b) a second portion responsive to user input of an identification of a cylinder to which the pickup lead is connected for storing waveform data acquired from that cylinder by the single pickup lead in the cylinder buffer dedicated to that cylinder; and (c) a third portion for displaying on the display screen waveform data from any cylinder buffers in which such data has been stored.

2. The apparatus of claim 1, wherein each cylinder buffer is a circular array of storage cells.

3. The apparatus of claim 2, wherein each cell of a buffer stores waveform data corresponding to at least a portion of a single firing cycle of the corresponding cylinder.

4. The apparatus of claim 3, wherein the third portion of the computer routine displays the waveform data for the most recently-acquired cylinder cycle for each cylinder.

5. The apparatus of claim 3, wherein the computer routine is operable in a live mode, wherein the second portion continuously stores waveform data for each cylinder cycle as it is acquired, and a saved mode, wherein the second portion of the computer routine does not acquire new wave form data.

6. The apparatus of claim 5, wherein the computer routine is operable in an unfrozen mode wherein the third portion of the computer routine can display from a buffer only waveform data corresponding to the most recently-stored cylinder cycle, and a frozen mode wherein the third portion of the computer routine can display waveform data corresponding to any: stored cylinder cycle.

7. The apparatus of claim 1, wherein the third portion of the computer routine displays the waveform data on two traces of the display device.

8. The apparatus of claim 7, wherein the third portion of the computer routine displays on one trace waveform data for a single selected cylinder and on the other trace waveform data in a multiple cylinder format for all cylinders for which waveform data has been stored.

9. Apparatus for analyzing the operation of a multi-cylinder, direct ignition, internal combustion engine wherein each cylinder has its own ignition coil with primary and secondary windings, said apparatus comprising:

a waveform acquisition circuit including an ignition pickup lead adapted to be coupled to a selected winding of each ignition coil one cylinder at a time for receiving primary or secondary analog input waveform signals from each cylinder and generation waveform data representative of such analog waveform signals, a user input device for inputting an identification of the cylinder to which the pickup lead is coupled, a storage memory, a display device having a display screen for displaying waveform data, and a processor coupled to said waveform acquisition circuit and said user input device and said memory and said display device and operating under stored program control, said processor executing a computer routine including a first portion, for establishing in the memory cylinder buffers respectively dedicated to the cylinders of the engine under test, and a second portion responsive to user input of an identification of a cylinder to which the pickup lead is connected for storing waveform data acquired from that cylinder in the cylinder buffer dedicated to that cylinder, and for displaying of the display screen waveform data for any cylinders for any cylinders for which such data has been stored.

10. The apparatus of claim 9, wherein the ignition pickup lead is either a primary lead or a secondary lead.

11. The apparatus of claim 9, wherein said user input device includes a mouse.

12. The apparatus of claim 9, wherein said processor executes a computer routine which displays waveform data on two traces of the display device.

13. The apparatus of claim 9, wherein each buffer is a circular array of a plurality of storage cells respectively storing waveform data corresponding to individual cycles of the associated cylinder.

14. A method of analyzing the operation of a multi-cylinder, direct ignition, internal combustion engine wherein each cylinder has its own ignition coil with primary and secondary windings, the method comprising the steps of:

asynchronously acquiring analog waveform signals from a winding of each coil using a single pickup lead sequentially connected to the coils one cylinder at a time, generating digital waveform data from the acquired analog waveform signals and storing the data so that the data for each cylinder is stored in a memory buffer dedicated to that cylinder and therefore can be distinguished from the data for other cylinders, and displaying waveform data for any cylinders for which such data has been stored.

15. The method of claim 14, wherein the displaying step includes simultaneously displaying waveform data for all cylinders for which such data has been stored.

16. The method of claim 14, wherein each cylinder buffer is a circular array of a plurality of storage cells respectively storing waveform data for individual firing cycles of the associated cylinder.

17. The method of claim 14, wherein the displaying step includes displaying the waveform data on plural traces of a screen of a display device.

18. The method of claim 17, wherein the displaying step includes displaying on one trace waveform data for a single selected cylinder an displaying on another trace waveform data for all cylinders for which data has been stored.

* * * * *

UNITED STATES PATENT AND TRADEMARK OFFICE

CERTIFICATE OF CORRECTION

PATENT NO. : 6,411,096 B1
DATED : June 25, 2002
INVENTOR(S) : Anthoni et al.

It is certified that error appears in the above-identified patent and that said Letters Patent is hereby corrected as shown below:

Column 13,
Line 19, delete ":";
Line 36, "generation" should be -- generating --.

Signed and Sealed this

Twenty-second Day of July, 2003

JAMES E. ROGAN
*Director of the United States Patent and Trademark Office*

UNITED STATES PATENT AND TRADEMARK OFFICE

CERTIFICATE OF CORRECTION

PATENT NO. : 6,411,096 B1
DATED : June 25, 2002
INVENTOR(S) : Anthoni et al.

It is certified that error appears in the above-identified patent and that said Letters Patent is hereby corrected as shown below:

Title page,
Item [56], References Cited, U.S. PATENT DOCUMENTS, "5,132,626" should be -- 5,132,625 --.

Column 12,
Line 53, after "coil", insert -- . --.

Column 14,
Line 6, delete "for any cylinders";
Line 17, after "individual", insert -- firing --.

Signed and Sealed this

Twenty-eighth Day of October, 2003

JAMES E. ROGAN
*Director of the United States Patent and Trademark Office*

UNITED STATES PATENT AND TRADEMARK OFFICE

CERTIFICATE OF CORRECTION

PATENT NO. : 6,411,096 B1
DATED : June 25, 2002
INVENTOR(S) : Anthoni et al.

It is certified that error appears in the above-identified patent and that said Letters Patent is hereby corrected as shown below:

Title page,
Item [56], References Cited, U.S. PATENT DOCUMENTS, "5,132,626" should be -- 5,132,625 --.

Column 12,
Line 53, after "coil", insert -- , --.

Column 14,
Line 6, delete "for any cylinders" second occurrence; and
Line 17, after "individual", insert -- firing --.

Signed and Sealed this

Twenty-seventh Day of January, 2004

JON W. DUDAS
*Acting Director of the United States Patent and Trademark Office*